United States Patent [19]

Hill

[11] Patent Number: 4,728,116

[45] Date of Patent: Mar. 1, 1988

[54] RELEASABLE BINDING FOR SNOWBOARDS

[76] Inventor: Kurt J. Hill, 1060 Fairway Court #3, Boulder, Colo. 80303

[21] Appl. No.: 865,118

[22] Filed: May 20, 1986

[51] Int. Cl.[4] ..... A63C 9/08

[52] U.S. Cl. ..... 280/618

[58] Field of Search ..... 280/12 H, 607, 613, 280/617, 618, 11.3

[56] References Cited

U.S. PATENT DOCUMENTS

| | | | |
|---|---|---|---|
| 3,088,748 | 5/1963 | Malmo | 280/12 H |
| 3,900,204 | 8/1975 | Weber | 280/607 |
| 3,924,869 | 12/1975 | Strub | 280/613 |
| 4,264,088 | 4/1981 | Replogle | 280/618 X |
| 4,361,344 | 11/1982 | Hull et al. | 280/613 |
| 4,403,785 | 9/1983 | Hottel | 280/12 H |
| 4,505,493 | 3/1985 | Gustavsson | 280/617 |

FOREIGN PATENT DOCUMENTS

| | | | |
|---|---|---|---|
| 2575660 | 7/1986 | France | 280/12 H |

*Primary Examiner*—John J. Love
*Assistant Examiner*—Michael Mar
*Attorney, Agent, or Firm*—Gerald J. Ferguson, Jr.; Michael P. Hoffman; Michael J. Foycik, Jr.

[57] ABSTRACT

A releasable foot binding for a snowboard includes a ring secured to a snowboard, a block rotatably mounted on the ring, and boot-engaging plugs at each end of the block.

3 Claims, 8 Drawing Figures

FIG. 3
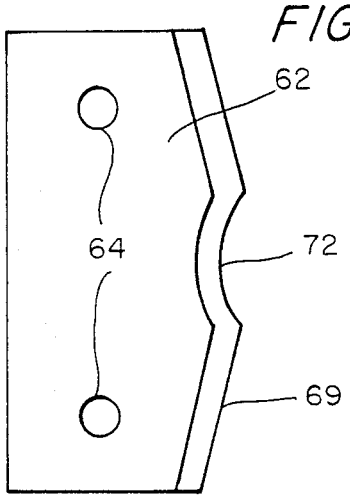
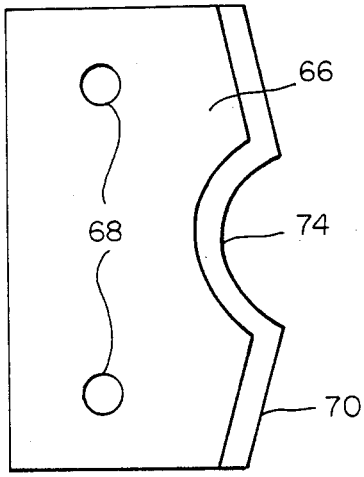
FIG. 4
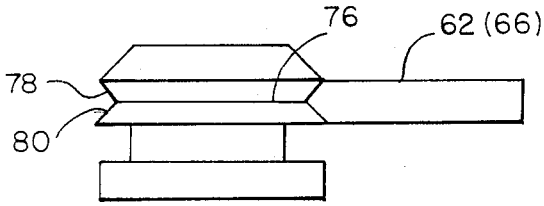
FIG. 5
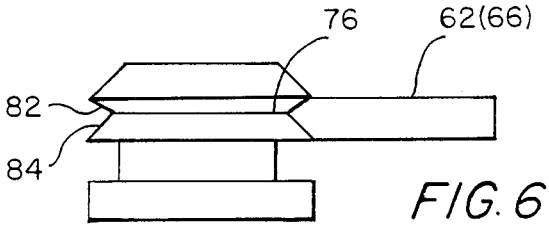
FIG. 6
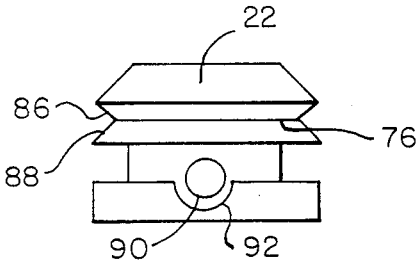
FIG. 7
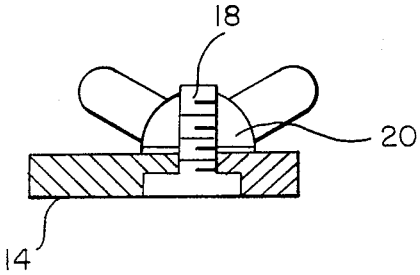
FIG. 8

RELEASABLE BINDING FOR SNOWBOARDS

BACKGROUND OF THE INVENTION

This invention relates to a releasable binding for snowboards. Present snowboards do not employ releasable bindings; instead, the rider's feet are strapped into the bindings, the straps having buckles or clips thereon with the bindings themselves being secured to the snowboard with screws. The result is that the rider's feet are not released from the board when the rider falls or when undue stress is placed on the rider's feet by other means, with the result that legs have been twisted and broken.

SUMMARY OF THE INVENTION

The present invention provides a releasable binding for snowboards which releases both side to side and up and down, so that in the event of a fall, for example, the snowboard is released from the rider's feet and no injury is sustained by the rider.

The binding of the present invention can be adjusted to vary the release or breakout point of the binding and also the binding is adjustable so that the rider's feet can be set at any desired angle to the snowboard itself.

BRIEF DESCRIPTION OF THE DRAWING

The invention will be further illustrated by reference to the accompanying drawings in which:

FIG. 3 is a top view of the toe interface plate, FIG. 4 is a top view of the heel interface plate, FIG. 5 is a view in elevation of one embodiment of an interface plug.

FIG. 6 is a view in elevation of a second embodiment of an interface plug,

FIG. 7 is a view in elevation of a third embodiment of an interface plug, and

FIG. 8 is a view in cross-section taken on line 8—8 of FIG. 1.

DETAILED DESCRIPTION OF A PREFERRED EMBODIMENT OF THE INVENTION

Figure 1:
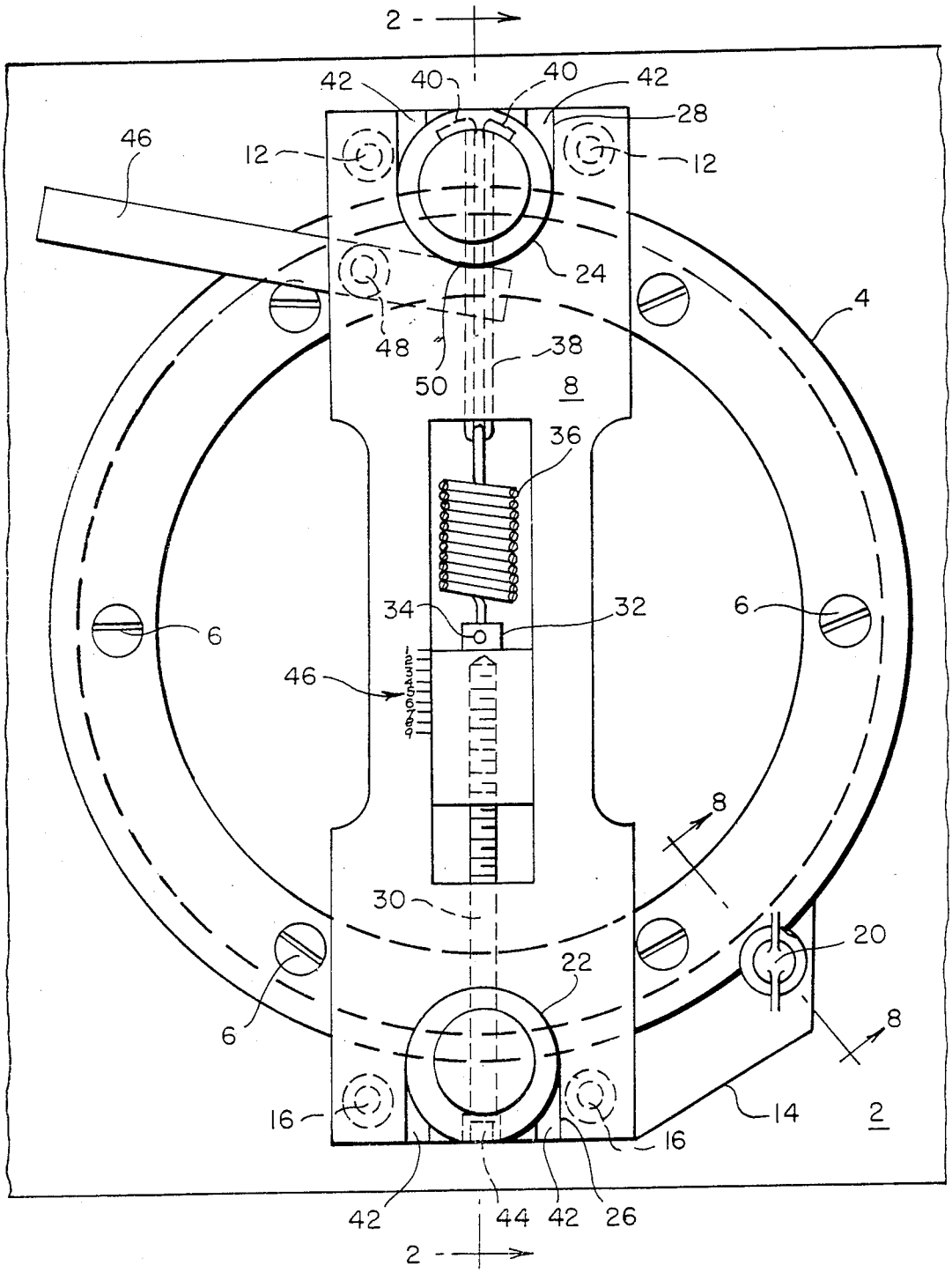
FIG. 1 is a top view of one embodiment of the binding of the present invention shown attached to a snowboard.
Figure 2:
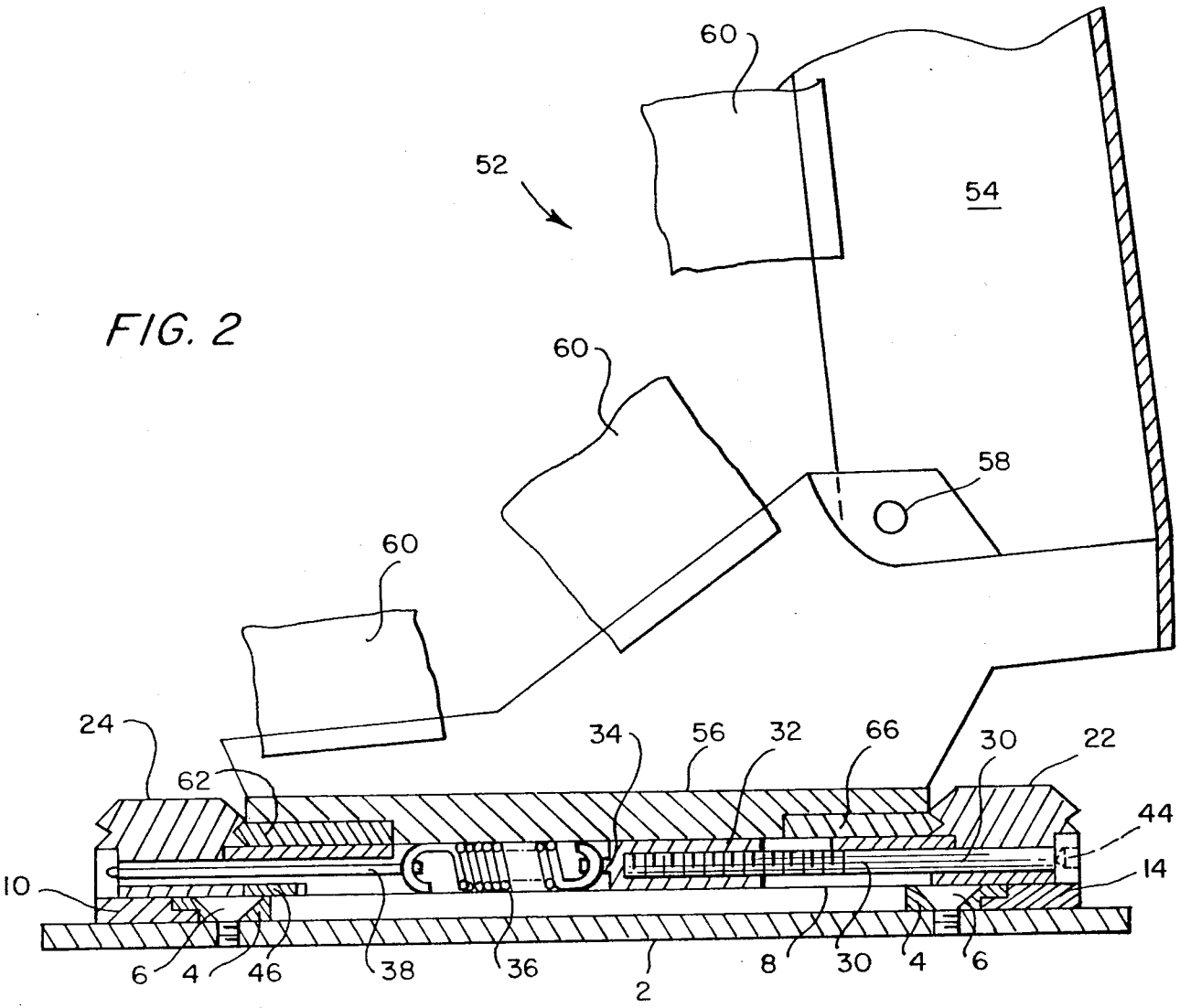
FIG. 2 is a sectional view taken on line 2—2 of FIG. 1 with the boot attached.

Referring to FIGS. 1 and 2, a snowboard 2 has a ring 4 secured thereto by the screws 6, a friction block 8 is mounted for rotation on the ring 4 and is prevented from lifting off the ring 4 by means of a rotational block 10 secured to one end of the friction block 8 by the screws 12, with the other end of the friction block 8 being secured by the rotational block 14 which latter is secured to the friction block 8 by the screws 16. The rotational block 14 may be locked to the ring 4 by means of the clamp shown in FIG. 8, which is composed of the bolt 18 in a counterbore in the rotational block 14, the bolt having the wing nut 20 thereon.

A pair of interface plugs 22 and 24 are mounted at opposite ends of the friction block 8 in the cutout portions 26 and 28 respectively. The interface plugs 22 and 24 are secured in the cutout portions 26 and 28 by means of the bolt 30 which threads into a slidable sleeve 32. The sleeve has a hook portion 34 on the end thereof which engages with a spring 36, which spring 36 in turn engages with the retaining wire 38, the ends of which are bent over as shown at 40 to secure the interface plug 24 to the spring 36, sleeve 32 and bolt 30.

Rail portions 42 are provided at each end of the friction block 8 so that the interface plugs 22 and 24 may move outwardly, i.e. away from each other as shown in FIGS. 1 and 2, in order to insert a boot into the binding or release a boot from the binding. The tension of the spring 36 may be varied by turning the bolt 30 by inserting an Allen wrench into the recess 44, and the degree of tension may be read from the scale 46 shown on the friction block 8 in FIG. 1.

Also shown in FIG. 1 is a release lever 47 which is pivotally mounted on the screw 48 and abuts against the interface plug 24 at 50. When the release lever 46 is biased against the interface plug 24 to push the plug outwardly, a boot retained by the plugs 22 and 24 will be released.

Referring to FIG. 2, a boot 52 is shown including the calf support 54, the boot base 56, and the boot pivot 58. The boot pivot 58 has two stops, one for forward lean and one for rear lean. This assists in walking and prevents one from overextending one's ankle in a fall. It is basically a one-size-fits-all ski boot shell in which one can wear any shoe or boot. The boot 52 is provided with the Velcro closure straps 60 or may be provided with buckles on straps if desired.

The toe interface plate 62 is secured to the front or toe of the boot 52 by means of screws which pass through the holes 64, while the heel interface plate 66 is secured to the rear or heel of the boot 52 by screws which pass through the holes 68. Both of the toe and heel interface plates are bevelled as shown at 69 and 70 respectively. The toe interface plate 62 has less radius 72 contacting the interface plug 24 than does the heel interface plate 66 contacting the interface plug 22, as shown at 74. The result is that the toe interface plate 62 releases before the heel does because there is less leverage out on one's toes. Inasmuch as the heel has more leverage, the heel interface plate 66 has more radius as shown at 74.

The ease of release of the interface plugs 22 and 24 may be varied by varying the angle of the groove in the plug which engages the interface plate 62 or 66. As shown in FIG. 5, an easier up-down release is provided if both portions of the groove 76 are 45 degrees, as shown at 78 and 80. A more difficult up-down release is provided if the upper portion of the groove 76 is 15 degrees, as shown at 82, and the lower portion of the groove is 45 degrees, as shown at 84, in FIG. 6.

FIG. 7 shows another variation of the interface plug 22 or 24 in which the upper portion of the groove 76 has an angle of 30 degrees, as shown at 86, and the lower portion of the groove has 45 degrees, as shown at 88. The difficulty of release of this embodiment is intermediate that of the embodiments shown at FIGS. 5 and 6. FIG. 7 also shows a bore 90 and counterbore 92 for receiving the bolt 30 which passes through the interface plug 22. The interface plug 24 is similarly bored but without a counterbore inasmuch as only the wire 38 passes therethrough and no counterbore is necessary, as is required to receive the head of the bolt 30.

In operation, when one steps into the binding with the boot 52 secured to one's foot, the toe interface plate 62 and heel interface plate 66 push outwardly on the interface plugs 22 and 24, which plugs slide on the rail portions 42 in the apertures 26 and 28 in the friction block 8. The interface plugs 22 and 24 are biased against the toe interface plate 62, and heel interface plates 66 by means of a spring 36, the tension on which can be adjusted by turning the bolt 30.

The position of the friction block 8 on the ring 4 can be adjusted by rotating the friction block 8 on the ring 4, together with the rotational blocks 10 and 14, as desired and locking it in place by means of the bolt 18 and wing nut 20 shown in FIG. 8. Thus, the rider's foot may be positioned at any angle as desired relative to the snowboard 2. Manual release of the boot 52 and the binding may be effected by manipulating the lever 46 which pivots about the screw 48 and may be employed to force the interface plug 24 outwardly thereby releasing the toe interface plate 62 from the toe interface plug 24.

Whereas the invention has been described specifically in connection with a binding for only one foot, it is to be understood that two bindings are used on a snowboard, with the result that both of the rider's feet may be positioned at any angle with respect to each other and to the snowboard itself by rotating the friction block 8 on the ring 4. Further, inasmuch as the binding is symmetrical, one may step into the binding in either direction.

It will be obvious to those skilled in the art that many modifications may be made within the scope of the present invention without departing from the spirit thereof and the invention includes all such modifications.

What is claimed is:

1. A releasable foot binding in combination with a snowboard and a boot having a toe interface plate and a heel interface plate, comprising:

ring means adapted to be fixedly secured to the snowboard;

friction block means rotatably mounted on said ring means;

rail means located in apertures at opposed ends of said friction block means;

first and second interface plug means mounted in said apertures for movement along said rail means, said first interface plug means having an annular groove therein for releasably receiving a projecting portion of said toe interface plate and said second interface plug means having an annular groove therein for releasably receiving a projecting portion of said heel interface plate;

spring means for resiliently urging said first and second interface plug means toward one another for releasably retaining the boot therebetween;

rotational block means for rotatably securing said friction block means to said ring means; and lever release means for moving one of said interface plug means away from said other interface plug means.

2. A releasable foot binding according to claim 1 including means for varying the tension of said spring means.

3. A releasable foot binding according to claim 1 including clamping means for clamping said rotational block means to said ring means.

* * * * *